US010644389B1

(12) United States Patent
Chueh et al.

(10) Patent No.: US 10,644,389 B1
(45) Date of Patent: May 5, 2020

(54) DOUBLE-FREQUENCY ANTENNA STRUCTURE WITH HIGH ISOLATION

(71) Applicant: NANNING FUGUI PRECISION INDUSTRIAL CO., LTD., Nanning (CN)

(72) Inventors: Yu-Chih Chueh, HsinChu (TW); Mao-Chang Chuang, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 29 days.

(21) Appl. No.: 16/175,863

(22) Filed: Oct. 31, 2018

(51) Int. Cl.

| | |
|---|---|
| ***H01Q 1/38*** | (2006.01) |
| ***H01Q 1/48*** | (2006.01) |
| ***H01Q 21/06*** | (2006.01) |
| ***H01Q 21/28*** | (2006.01) |

(52) U.S. Cl.
CPC ..... *H01Q 1/38* (2013.01); *H01Q 1/48* (2013.01); *H01Q 21/065* (2013.01); *H01Q 21/28* (2013.01)

(58) Field of Classification Search
CPC .. H01Q 1/38; H01Q 1/42; H01Q 1/48; H01Q 21/24; H01Q 21/245; H01Q 21/28; H01Q 21/30; H01Q 21/06; H01Q 21/065; H01Q 5/364; H01Q 7/00; H01Q 9/265
See application file for complete search history.

(56) References Cited

U.S. PATENT DOCUMENTS

| | | | | |
|---|---|---|---|---|
| 4,749,996 | A * | 6/1988 | Tresselt | H01Q 9/0414 343/700 MS |
| 5,087,920 | A * | 2/1992 | Tsurumaru | H01Q 21/0081 343/700 MS |
| 5,652,595 | A * | 7/1997 | Ahrens | H01Q 9/0407 343/700 MS |
| 7,800,552 | B2 * | 9/2010 | Nakaya | H01Q 3/24 343/700 MS |
| 8,587,480 | B2 * | 11/2013 | Kim | H01Q 9/0442 343/700 MS |
| 10,333,214 | B2 * | 6/2019 | Kushta | H01Q 1/38 |
| 2005/0179596 | A1 * | 8/2005 | Higasa | H01Q 1/38 343/700 MS |
| 2015/0116174 | A1 * | 4/2015 | Yona | H01Q 1/38 343/797 |

FOREIGN PATENT DOCUMENTS

| | | |
|---|---|---|
| CN | 102832461 B | 4/2015 |
| CN | 206619691 U | 11/2017 |
| TW | 201712950 A | 4/2017 |

* cited by examiner

*Primary Examiner* — Tho G Phan
(74) *Attorney, Agent, or Firm* — ScienBiziP, P.C.

(57) ABSTRACT

A double-frequency antenna structure with a high degree of electrical isolation between long distance and short distance antennas includes a dielectric substrate having at least two corners and a center area. A first set of antenna arrays is positioned at the corners. A second set of antenna arrays is positioned at the center area. At least one first folded isolation plate is mounted on the dielectric substrate, and positioned between the first set of antenna arrays and the second set of antenna arrays. At least one second folded isolation plate each is mounted on one first folded isolation plate.

14 Claims, 8 Drawing Sheets

DOUBLE-FREQUENCY ANTENNA STRUCTURE WITH HIGH ISOLATION

FIELD

The subject matter herein generally relates to antennas.

BACKGROUND

Multi-input and multi-output (MIMO) wireless communication devices utilize multiple antennas for transmitting and receiving electromagnetic waves. Exhibiting spatial diversity, the MIMO wireless communication devices have higher throughput and longer transmission distance than traditional wireless communication devices without sacrificing transmission bandwidth or increasing power consumption. Thus, MIMO wireless communication devices are used in almost all wireless communication products.

However, the wireless communication products is often miniaturized, so the distance between multiple antennas is becoming shorter which may result in mutual interference problems. To increase isolation between the antennas, metal sheets can be inserted between the antennas. Although such known methods are somewhat useful, inserting metal sheets may not isolate the antennas completely.

Therefore, there is room for improvement in the art.

BRIEF DESCRIPTION OF THE DRAWINGS

Implementations of the present disclosure will now be described, by way of embodiments only, with reference to the attached figures.

DETAILED DESCRIPTION

Figure 1:
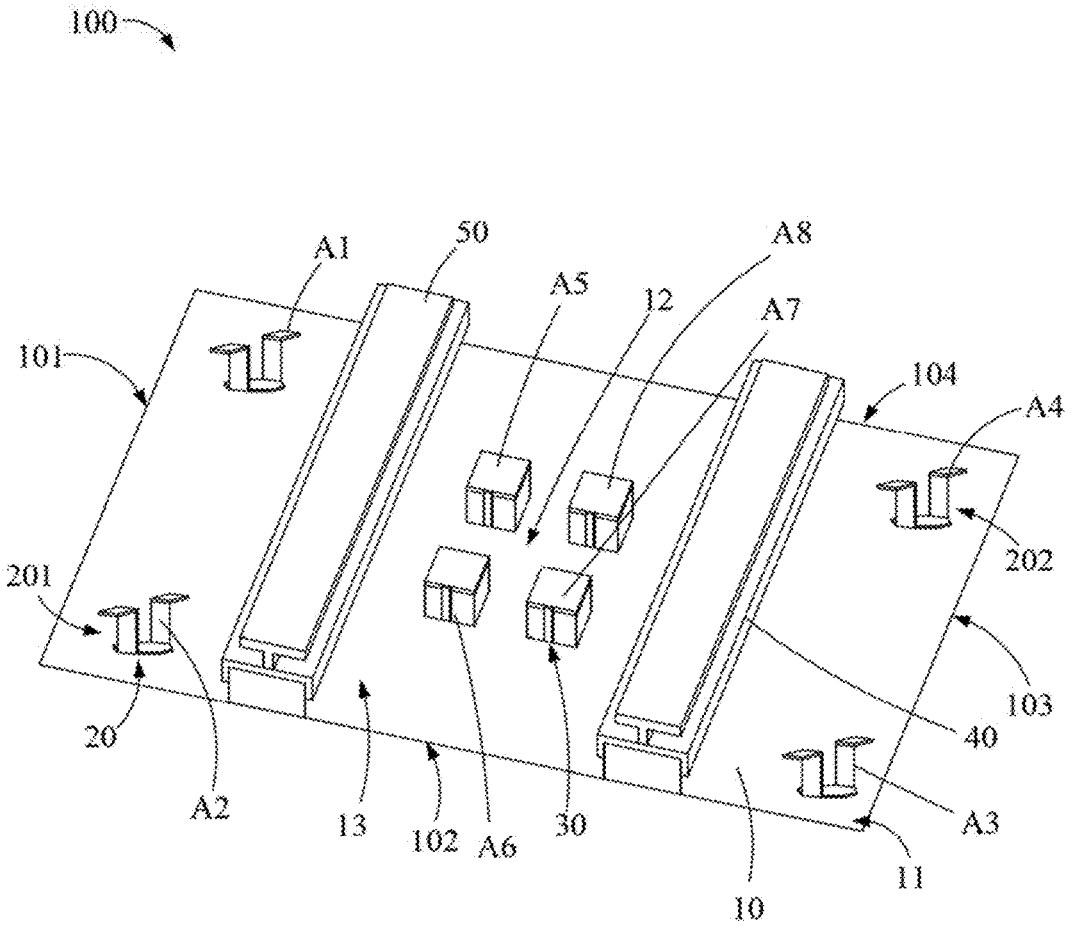
FIG. 1 is a diagrammatic view of an embodiment of a double-frequency antenna structure according to the present disclosure.

It will be appreciated that for simplicity and clarity of illustration, where appropriate, reference numerals have been repeated among the different figures to indicate corresponding or analogous components. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

FIG. 1 illustrates a double-frequency antenna structure 100. The structure 100 can be mounted on a wall or a ceiling, and also can be mounted in a mobile terminal such as a cell phone, a tablet computer, a hot spot, or a USB wireless transceiver. The structure 100 includes a dielectric substrate 10, a first set of antenna arrays 20, a second set of antenna arrays 30, two first folded isolation plates 40, and two second folded isolation plates 50.

The dielectric substrate 10 includes a first surface 13 and a second surface (not shown) opposite to the first surface 13. The first surface 13 includes a number of corners 11 and a center area 12. The second surface is coated with electric conductive material to act as a ground. In at least one embodiment, the dielectric substrate 10 is substantially rectangular or square, which includes a first side 101, a second side 102, a third side 103, and a fourth side 104 connected in that order. The first side 101 faces and is parallel to the third side 103. The second side 102 faces and is parallel to the fourth side 104. The first side 101, the second side 102, the third side 103, and the fourth side 104 cooperatively define four corners 11. The dielectric substrate 10 can be a printed circuit board, which has a length and a width of about 200 mm and a thickness less than 10 mm.

Each of the first set of antenna arrays 20 is positioned at each of the corners 11 of the first surface 13. The second set of antenna arrays 30 is positioned at the center area 12 of the first surface 13. The first set of antenna arrays 20 and the second set of antenna arrays 30 have different radiation patterns. In at least one embodiment, a range of operating frequency of the first set of antenna arrays 20 is overlapped with a range of operating frequency of the second set of antenna arrays 30. A difference between a maximum operating frequency of the first set of antenna arrays 20 and a maximum operating frequency of the second set of antenna arrays 30 is not less than 100 MHz. In use, the first set of antenna arrays 20 transmit long distance communication and the second set of antenna arrays 30 transmit short distance communication. The first set of antenna arrays 20 has an omni-directional radiation pattern. The second set of antenna arrays 30 has a directional radiation pattern.

In at least one embodiment, the first set of antenna arrays 20 includes a first antenna A1, a second antenna A2, a third antenna A3, and a fourth antenna A4, which are positioned at the four corners 11. The second set of antenna arrays 30 includes a fifth antenna A5, a sixth antenna A6, a seventh antenna A7, and an eighth antenna A8, which are positioned at the center area 12. Each of the first antenna A1, the second antenna A2, the third antenna A3, and the fourth antenna A4 is a monopole antenna. Each of the fifth antenna A5, the sixth antenna A6, the seventh antenna A7, and the eighth antenna A8 is a patch antenna. The fifth antenna A5 and the sixth antenna A6 are positioned near the first antenna A1 and the second antenna A2, respectively. The seventh antenna A7 and the eighth antenna A8 are positioned near the third antenna A3 and the fourth antenna A4, respectively.

The second set of antenna arrays 30 divides the first set of antenna arrays 20 into a first portion 201 (including the first antenna A1 and the second antenna A2) at one side of the second set of antenna arrays 30, and a second portion 202 (including the third antenna A3 and the fourth antenna A4) at the other side of the second set of antenna arrays 30. Each of the two first folded isolation plates 40 is mounted on the dielectric substrate 10. One of the two first folded isolation plates 40 is positioned between the first portion 201 and the second set of antenna arrays 30, and the other one of the two first folded isolation plates 40 is positioned between the second portion 202 and the second set of antenna arrays 30. The first folded isolation plates 40 are made of electric conductive material such as metal. Each of the first folded isolation plates 40 forms a wall to block electric lines at each side of each of the first folded isolation plates 40. Thus, any mutual coupling can be reduced, increasing the degree of isolation between the first set of antenna arrays 20 and the second set of antenna arrays 30.

Figure 2:
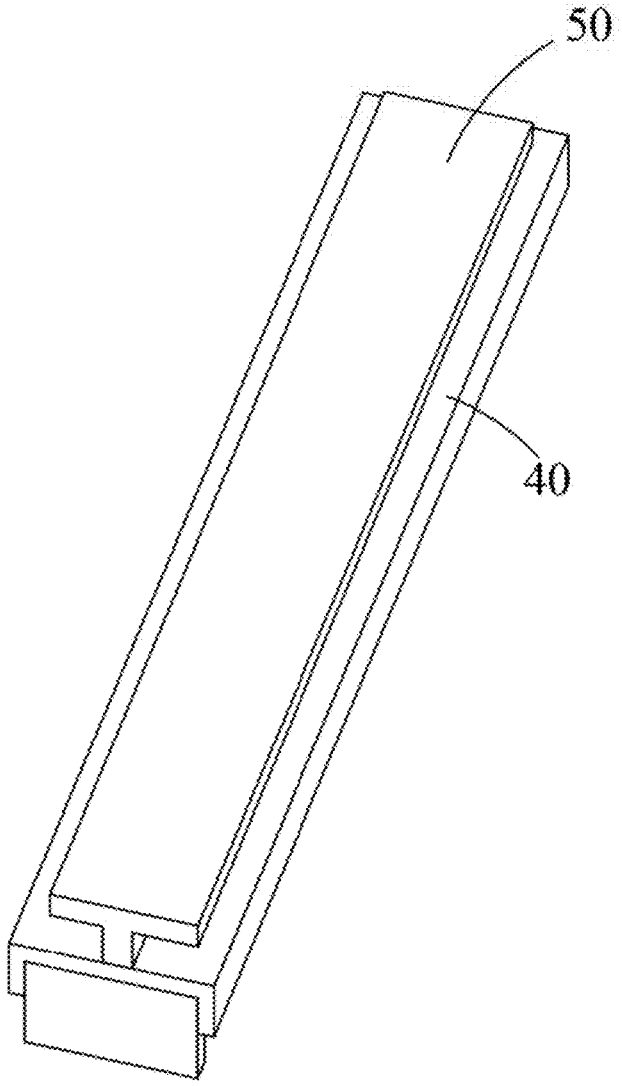
FIG. 2 is a diagrammatic view of a first folded isolation plate and a second folded isolation plate of the double-frequency antenna structure of FIG. 1.
Figure 3:
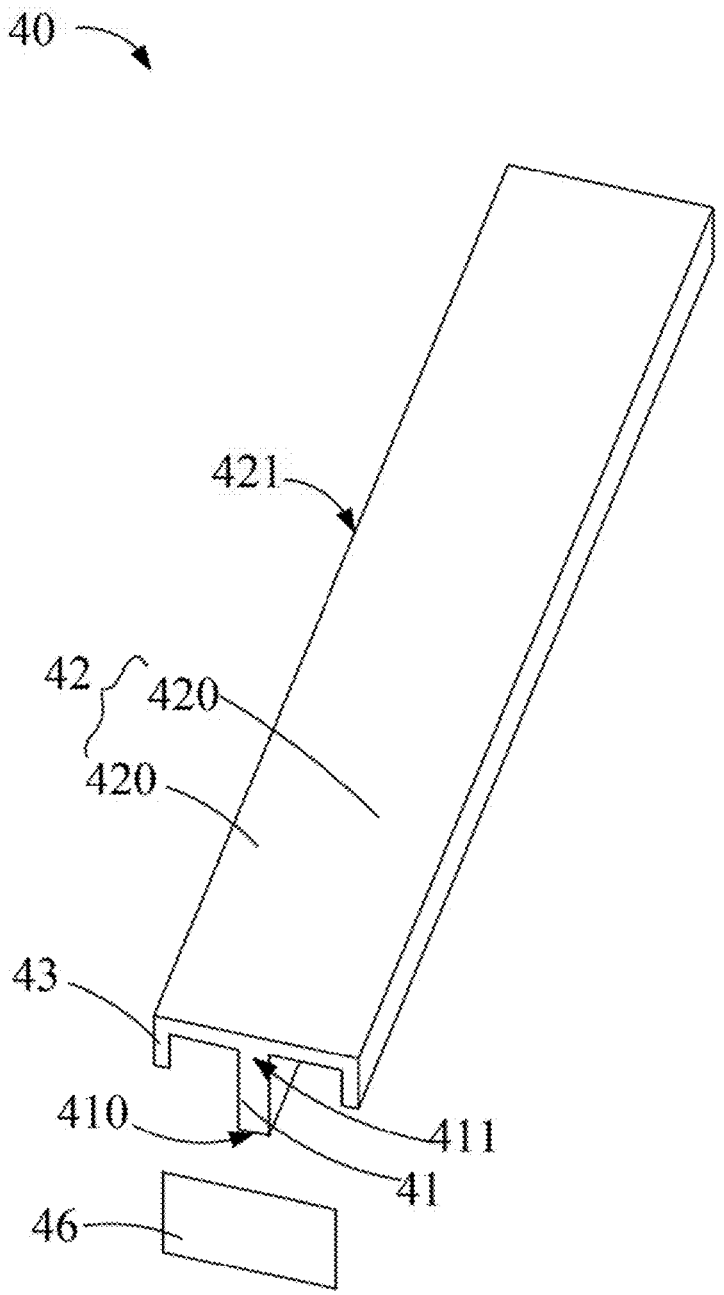
FIG. 3 is an enlarged diagrammatic view of the first isolation plate of FIG. 2.

FIGS. 2 and 3 illustrate that each of the first folded isolation plates 40 extends along a direction that is parallel to the first side 101 and the third side 103, and extends from the second side 102 to the fourth side 104. Each of the first folded isolation plates 40 includes a first supporting wall 41, a first top plate 42, and two extension walls 43. The first supporting wall 41 includes a first bottom portion 410 and a first top portion 411 opposite to the first bottom portion 410. The first supporting wall 41 is mounted to the dielectric substrate 10 through the first bottom portion 410. The first top plate 42 is connected to the first top portion 411, and the first top portion 411 divides the first top plate 42 into two first top plate portions 420 which are at two sides of the first supporting wall 41. Thus, the first supporting wall 41 and the first top plate 42 are substantially T-shaped when connected to each other. In at least one embodiment, the two first top plate portions 420 can have a same width. The width of each of the first top plate portions 420 can be equal to a quarter of the wavelength of the range of operating frequency of the first set of antenna arrays 20 or a quarter of that of the second set of antenna arrays 30. Each of the first top plate portions 420 has a ninth side 421 that is parallel to and opposite to the first top portion 411. Each of the extension walls 43 extends from the ninth side 421 of each of the first top plate portions 420, along a direction parallel to the first supporting wall 41. Each of the extension walls 43 can be shorter than the first supporting wall 41. In at least one embodiment, the first supporting wall 41 has a height of about 7 mm. The first top plate 42 has a width of about 16.5 mm.

In at least one embodiment, each of the first folded isolation plates 40 can further includes two supporting plates 46. Each of the two supporting plates 46 is mounted to each end portion of the first supporting walls 41. The supporting plates 46 increase the structural strength of the first folded isolation plates 40.

Figure 4:
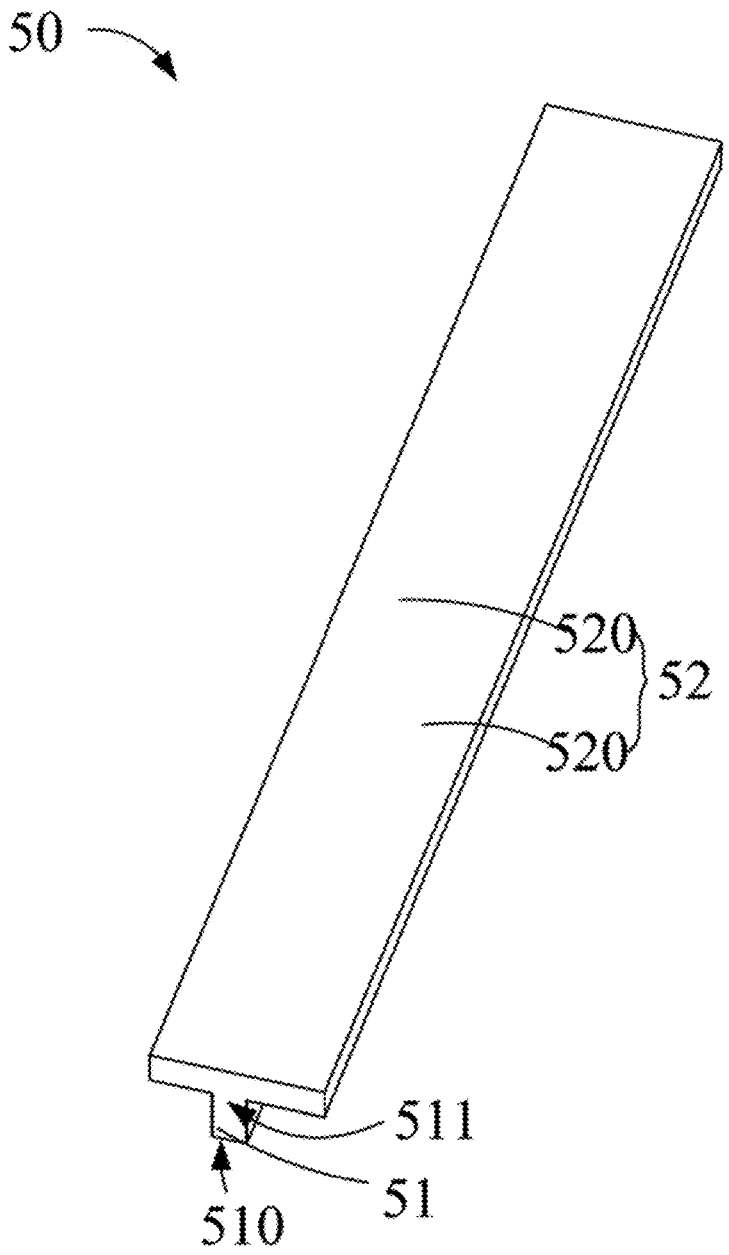
FIG. 4 is an enlarged diagrammatic view of the second isolation plate of FIG. 2.

FIGS. 2 and 4 illustrate that each of the second folded isolation plates 50 is mounted on each of the first folded isolation plates 40. The second folded isolation plates 50 and the first folded isolation plates 40 can have a same extending direction and a same length. The second folded isolation plates 50 further increase the isolation between the first set of antenna arrays 20 and the second set of antenna arrays 30.

Each of the second folded isolation plates 50 includes a second supporting wall 51 and a second top plate 52. The second supporting wall 51 includes a second bottom portion 510 and a second top portion 511 opposite to the second bottom portion 510. Each of the second folded isolation plates 50 is mounted to each of the first top plates 42 through the second bottom portion 510. The second supporting wall 51 is aligned with the first supporting wall 41. The second top plate 52 is connected to the second top portion 511, and the second top portion 511 divides the second top plate 52 into two second top plate portions 520 at two sides of the second supporting wall 51. Thus, each of the second folded isolation plates 50 is substantially T-shaped. In at least one embodiment, the second supporting wall 51 is shorter than the first supporting walls 41. The second top portion 52 is substantially parallel to the first top portion 42. A width of the second top portion 52 is less than the width of the first top portion 42. In at least one embodiment, the second supporting wall 51 has a width of about 3 mm. The second top portion 52 has a width of about 12.5 mm.

Figure 5:
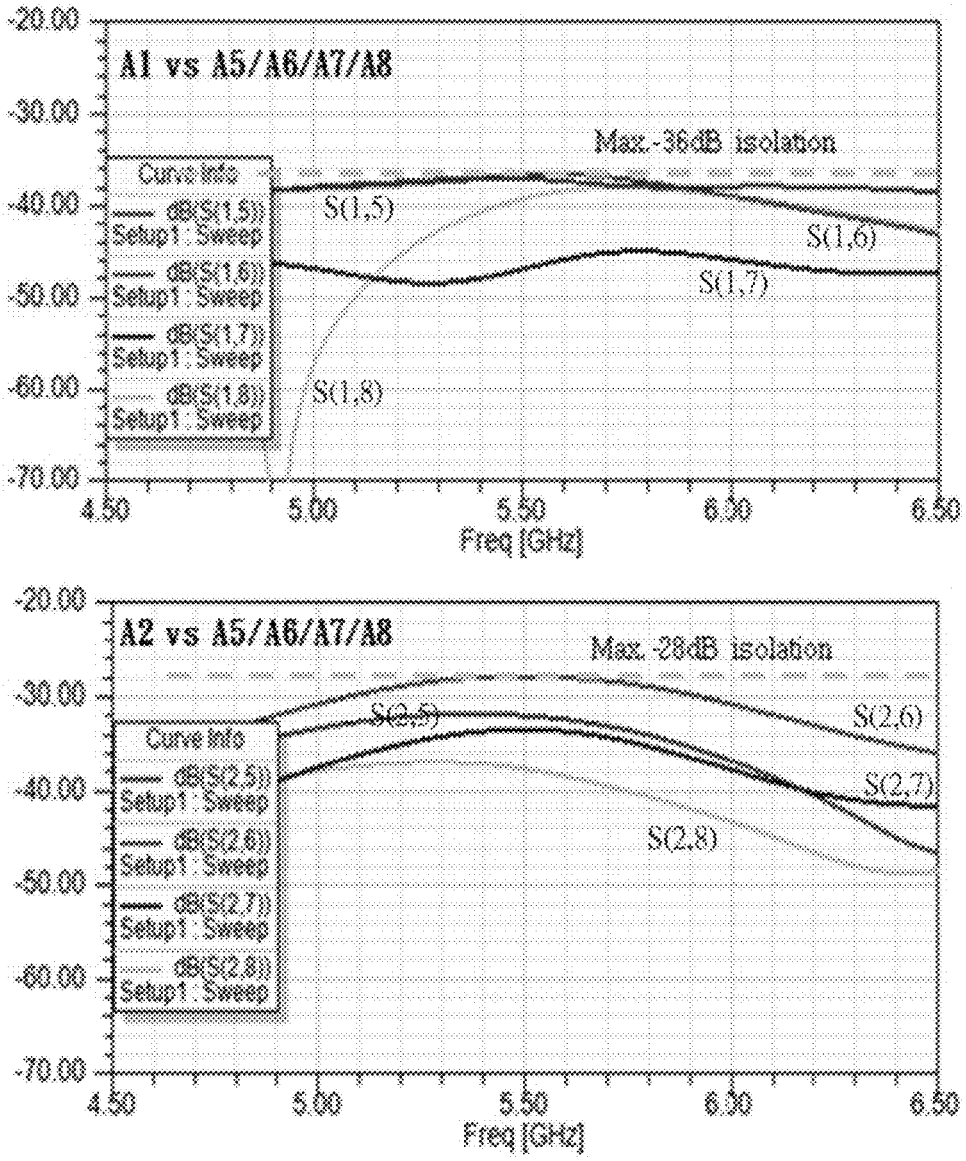
FIG. 5 is a diagram of degree of isolation between a first set of antenna arrays and a second set of antenna arrays in a conventional double-frequency antenna structure.
Figure 6:
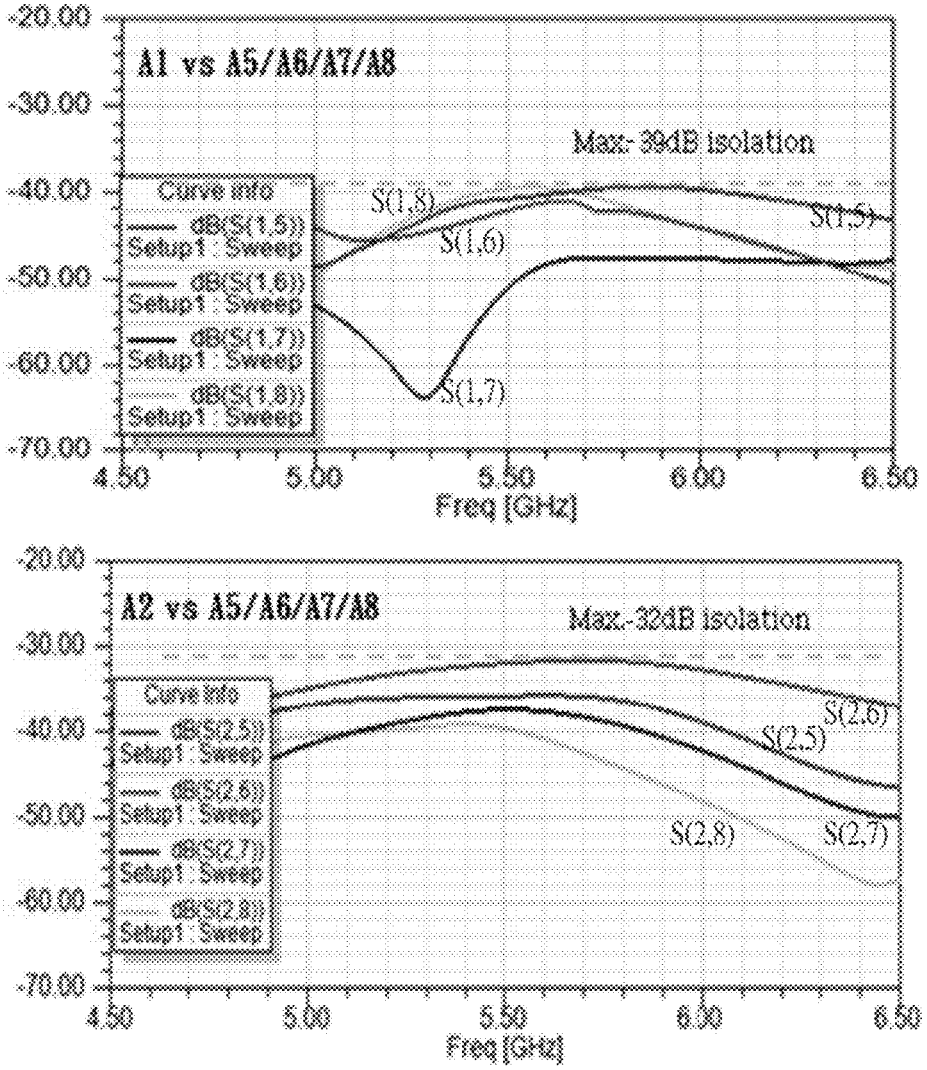
FIG. 6 is similar to FIG. 5, except conventional metal sheets are inserted between the first set of antenna arrays and the second set of antenna arrays.
Figure 7:
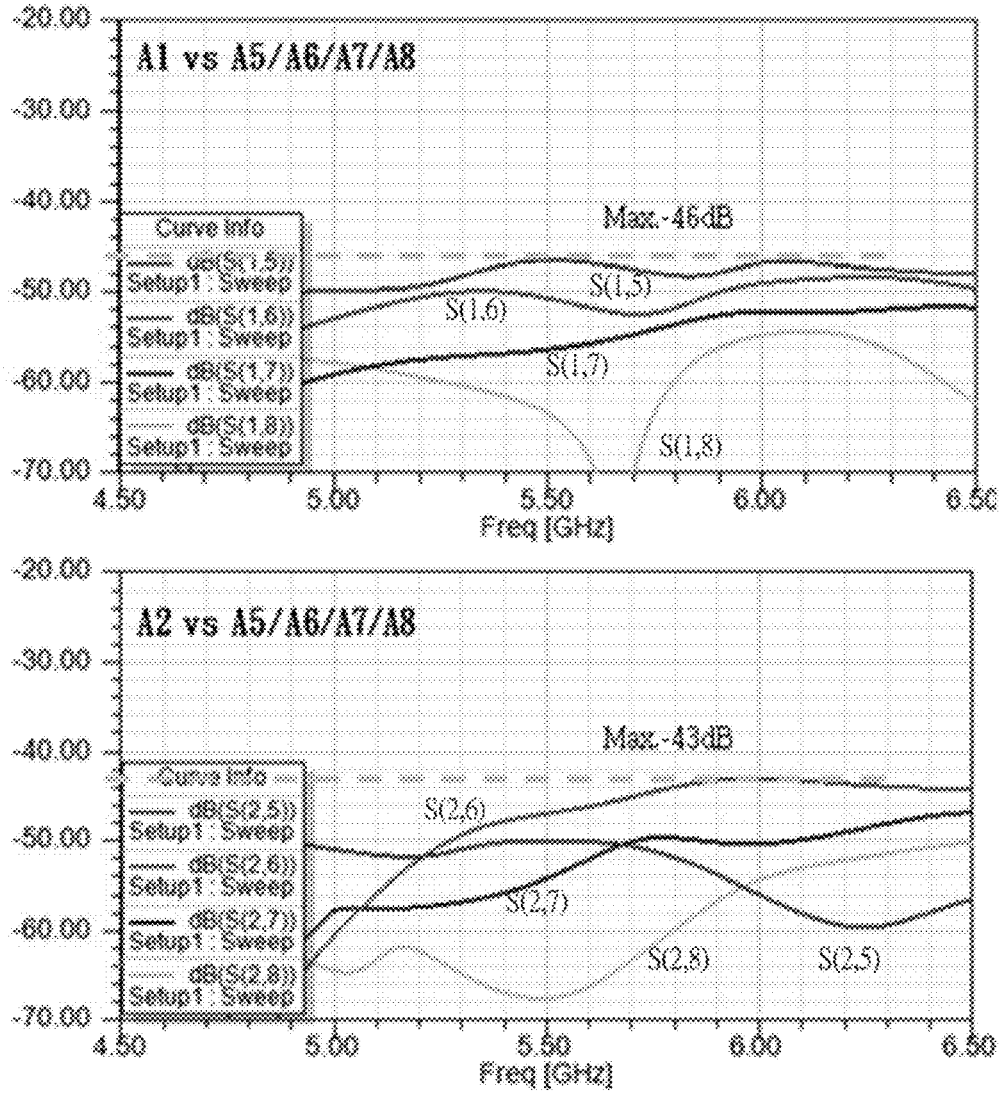
FIG. 7 is a diagram of degree of isolation between a first set of antenna arrays and a second set of antenna arrays in the double-frequency antenna structure of FIG. 1.

FIGS. 5, 6, and 7 show, respectively, degrees of isolation in a conventional double-frequency antenna structure without metal sheets, in a conventional double-frequency antenna structure with metal sheets, and in the structure 100 as disclosed. In the present embodiment, the metal sheet has a height of 100 mm. The first folded isolation plate 40 has a height of 7 mm. The second folded isolation plate 50 has a height of 3 mm. That is, a total height of the first folded isolation plate 40 and the second folded isolation plate 50 is equal to the height of the metal sheet. The degrees of isolation are tested by setting the first antenna A1 as a first port (Port 1), and each of the fifth antenna A5, the sixth antenna A6, the seventh antenna A7, and the eighth antenna A8 as a second port (Port 2), wherein the degrees of isolation between the first set of antenna arrays 20 and the second set of antenna arrays 30 are labeled as S(1,5), S(1,6), S(1,7), and S(1,8). Similarly, by setting the second antenna A2 as the first port (Port 1), and each of the fifth antenna A5, the sixth antenna A6, the seventh antenna A7, and the eighth antenna A8 as the second port (Port 2), the degree of isolation between the first set of antenna arrays 20 and the second set of antenna arrays 30 is labeled as S(2,5), S(2,6), S(2,7), and S(2,8).

Referring to FIG. 5, the maximum degree of isolation between the first set of antenna arrays 20 and the second set of antenna arrays 30, in the conventional double-frequency antenna structure without metal sheets, are respectively −36 dB and −28 dB. Referring to FIG. 6, when the metal sheets are added, the maximum degree of isolation between the first set of antenna arrays 20 and the second set of antenna arrays 30 are respectively −39 dB and −32 dB. That is, the degree of isolation is increased by about −3 dB when the metal sheets are added. FIG. 7 shows that when the range of operating frequency is from 5 GHz to 6 GHz, the maximum degree of isolation between the first set of antenna arrays 20 and the second set of antenna arrays 30 are respectively −46 dB and −43 dB. According to the present embodiment, the degree of isolation is increased by about −10 dB with the first folded isolation plates 40 and the second folded isolation plates 50 added.

Figure 8:
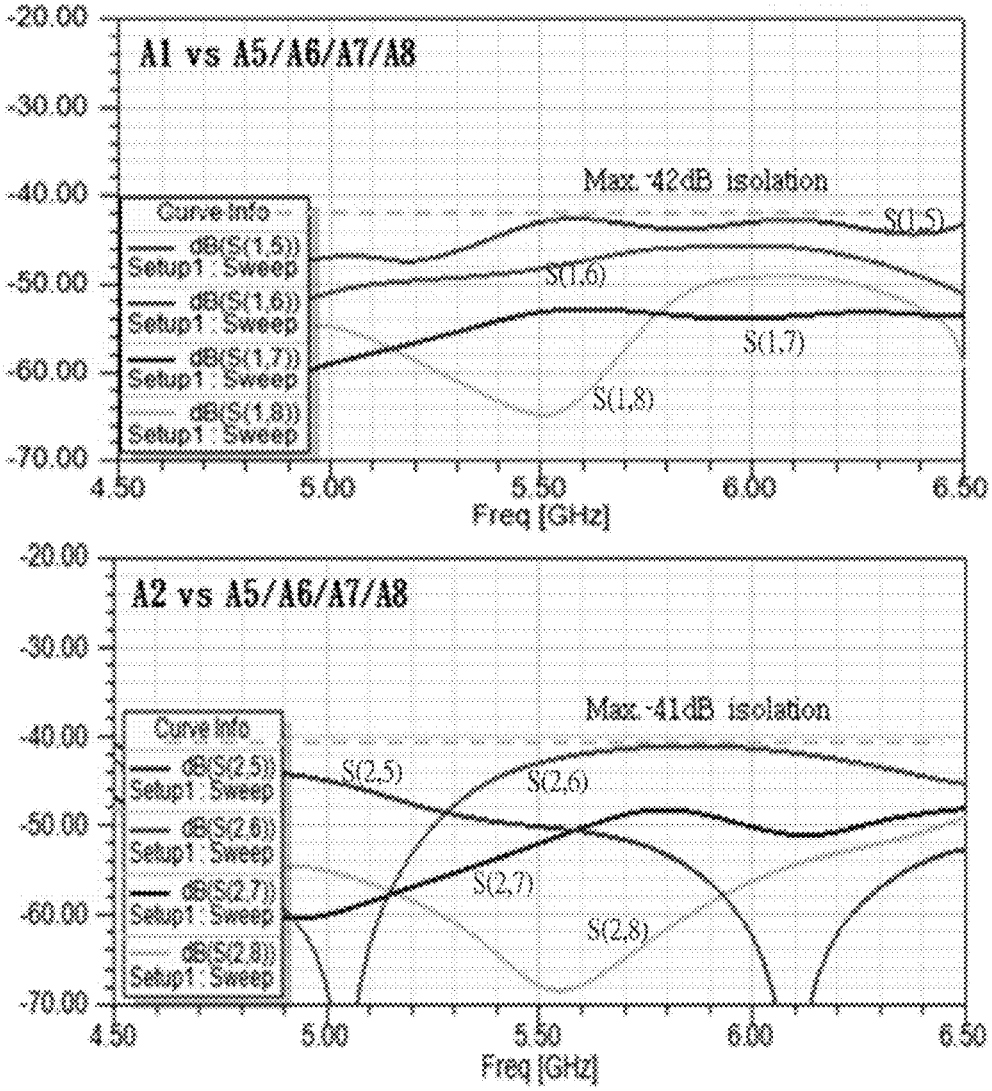
FIG. 8 is similar to FIG. 7, except the second isolation plate is removed.

Referring to FIG. 8, another embodiment without the second folded isolation plates 50 in the structure 100, the maximum degree of isolation between the first set of antenna arrays 20 and the second set of antenna arrays 30 is −42 dB and −41 dB. That is, the degree of isolation is increased by about −6 dB when the first folded isolation plates 40 are added, according to the present embodiment. Thus, the second folded isolation plates 50 can further increase the isolation between the first set of antenna arrays 20 and the second set of antenna arrays 30.

In other embodiments, the number and the positions of antennas of the first set of antenna arrays 20 and the second set of antenna arrays 30 can be varied. For example, the first set of antenna arrays 20 can include the first antenna A1 and the second antenna A2. The second set of antenna arrays 30 can include the fifth antenna A5 and the sixth antenna A6.

Furthermore, the first set of antenna arrays 20 is positioned at a single side of the second set of antenna arrays 30. In these embodiments, one first folded isolation plate 40 and one second folded isolation plate 50 are included, the first folded isolation plate 40 and the second folded isolation plate 50 being set between the first set of antenna arrays 20 and the second set of antenna arrays 30. In other embodiments, the first folded isolation plate 40 and the second folded isolation plate 50 can also be used to separate two antennas to improve isolation.

The embodiments shown and described above are only examples. Therefore, many commonly-known features and details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will, therefore, be appreciated that the embodiments described above may be modified within the scope of the claims.

What is claimed is:

1. A double-frequency antenna structure comprising:

a dielectric substrate comprising at least two corners and a center area;

a first set of antenna arrays positioned at each of the corners of the dielectric substrate;

a second set of antenna arrays positioned at the center area;

at least one first folded isolation plate mounted on the dielectric substrate and positioned between the first set of antenna arrays and the second set of antenna arrays, each of the at least one first folded isolation plate comprising a first supporting wall, a first top plate, and two extension walls, the first supporting wall comprising a first bottom portion and a first top portion opposite to the first bottom portion, the first supporting wall being mounted to the dielectric substrate through the first bottom portion, the first top plate being connected to the first top portion, the first top portion dividing the first top plate into two first top plate portions which are positioned at two sides of the first supporting wall, each of the first top plate portions having a side which is parallel to and opposite to the first top portion, each of the extension walls extending from the side of each of the first top plate portions along a direction parallel to the first supporting wall; and at least one second folded isolation plate each mounted on each of the first folded isolation plate, each of the second folded isolation plate comprising a second supporting wall and a second top plate, the second supporting wall comprising a second bottom portion and a second top portion opposite to the second bottom portion, each of the second folded isolation plate being mounted to each of the first top plates through the second bottom portion, the second top plate being connected to the second top portion, the second top portion dividing the second top plate into two second top plate portions at two sides of the second supporting wall.

2. The double-frequency antenna structure of claim 1, wherein the second set of antenna arrays divides the first set of antenna arrays into a first portion at one side of the second set of antenna arrays and a second portion at another side of the second set of antenna arrays, the double-frequency antenna structure comprises two first folded isolation plates and two second folded isolation plates, one of the at least one first folded isolation plate is positioned between the first portion and the second set of antenna arrays, and another one of the first folded isolation plate is positioned between the second portion and the second set of antenna arrays.

3. The double-frequency antenna structure of claim 1, wherein each of the first folded isolation plate further comprises two supporting plates, and each of the two supporting plates is mounted to each end portion of the first supporting walls.

4. The double-frequency antenna structure of claim 1, wherein each of the extension walls is shorter than the first supporting wall, the second supporting wall is aligned with the first supporting wall, and the second supporting wall is shorter than the first supporting wall.

5. The double-frequency antenna structure of claim 1, wherein the second top portion is parallel to the first top portion.

6. The double-frequency antenna structure of claim 1, wherein the dielectric substrate comprises a first surface and a second surface opposite to the first surface, the corners and the center area are on the first surface, and the second surface is adapted to be electrically ground.

7. The double-frequency antenna structure of claim 6, wherein the dielectric substrate is rectangular or square, which comprises a first side, a second side, a third side, and a fourth side connected in that order, the first side faces and is parallel to the third side, the second side faces and is parallel to the fourth side, each of the first folded isolation plate extends along a direction that is parallel to the first side and the third side, and extends from the second side to the fourth side, and the second folded isolation plate and the first folded isolation plate have a same extending direction and a same length.

8. The double-frequency antenna structure of claim 1, wherein the first set of antenna arrays and the second set of antenna arrays have different radiation patterns, and a range of operating frequency of the first set of antenna arrays is greater than a range of operating frequency of the second set of antenna arrays.

9. The double-frequency antenna structure of claim 8, wherein the first set of antenna arrays has an omni-directional radiation pattern, and the second set of antenna arrays has a directional radiation pattern.

10. The double-frequency antenna structure of claim 8, wherein the first set of antenna arrays comprises a plurality of monopole antenna, and the second set of antenna arrays comprises a plurality of patch antenna.

11. An antenna structure comprising:

a dielectric substrate;

a first antenna positioned on the dielectric substrate;

a second antenna positioned on the dielectric substrate;

a first folded isolation plate mounted on the dielectric substrate and positioned between the first antenna and the second antenna, the first folded isolation plate comprising a first supporting wall, a first top plate, and two extension walls, the first supporting wall comprising a first bottom portion and a first top portion opposite to the first bottom portion, the first supporting wall being mounted to the dielectric substrate through the first bottom portion, the first top plate being connected to the first top portion, the first top portion dividing the first top plate into two first top plate portions which are positioned at two sides of the first supporting wall, each of the first top plate portions having a side that is parallel to and opposite to the first top portion, each of the extension walls extending from the side of each of the first top plate portions along a direction parallel to the first supporting wall; and a second folded isolation plate mounted on the first folded isolation plate, the second folded isolation plate comprising a second supporting wall and a second top plate, the second supporting wall comprising a second bottom portion and a second top portion opposite to the second bottom portion, the second folded isolation plate being mounted to the first top plate through the second bottom portion, the second top plate being connected to the second top portion, the second top portion dividing the second top plate into two second top plate portions at two sides of the second supporting wall.

12. The antenna structure of claim 11, wherein the first folded isolation plate further comprises two supporting plates, and the two supporting plates are mounted to two end portions of the first supporting walls.

13. The antenna structure of claim 11, wherein each of the extension walls is shorter than the first supporting wall, the second supporting wall is aligned with the first supporting wall, and the second supporting wall is shorter than the first supporting walls.

14. The antenna structure of claim 11, wherein the second top portion is parallel to the first top portion.

* * * * *